United States Patent [19]

Rusche

[11] 4,158,518

[45] Jun. 19, 1979

[54] IN SITU PILE FORMING METHOD

[76] Inventor: Fredric Rusche, 30303 Beck Rd., Wixom, Mich. 48096

[21] Appl. No.: 832,947

[22] Filed: Sep. 13, 1977

[51] Int. Cl.[2] ..... E02D 5/42

[52] U.S. Cl. ..... 405/240; 405/233; 405/242

[58] Field of Search ..... 61/53.52, 53.58, 53.62, 61/53.64, 53.66, 56.5

[56] References Cited

U.S. PATENT DOCUMENTS

| | | | |
|---|---|---|---|
| 1,904,079 | 4/1933 | Powell | 61/53.64 X |
| 2,146,645 | 2/1939 | Newman | 61/53.64 X |
| 2,162,108 | 6/1939 | Newman | 61/53.64 X |
| 3,434,294 | 3/1969 | Hall | 61/53.64 X |
| 3,772,894 | 11/1973 | Godley et al. | 61/53.64 X |
| 3,793,844 | 2/1974 | Chelminski | 61/53.64 X |
| 4,045,966 | 9/1977 | Rusche | 61/53.64 |

*Primary Examiner*--Mervin Stein
*Assistant Examiner*—David H. Corbin
*Attorney, Agent, or Firm*—Littlepage, Quaintance, Murphy, Richardson and Webner

[57] ABSTRACT

After wet-drilling a hole until a bearing strata is reached, a mandrel with a removable overboot is lowered into the hole and the overboot is seated by a few hammer blows. The mandrel is than partly filled with thick concrete from its top, the top of the mandrel sealed, air-pressurized and a mechanical lifting force is applied. The pressure of the air within the mandrel plus the weight of the concrete forces off the overboot, and also forces the thick concrete against the sides of the hole, and the concrete forms a seal between the sides of the hole and the mandrel. The air pressure also helps lift the mandrel out of the hole.

4 Claims, 7 Drawing Figures

IN SITU PILE FORMING METHOD

RELATED APPLICATION

Rusche Ser. No. 621,682 filed Oct. 14, 1975 for CASINGLESS PILE METHOD AND APPARATUS.

1. FIELD OF INVENTION

Hydraulic And Earth Engineering, Casting in situ hardenable fluent material, Dispensing fluent material while withdrawing dispenser.

b 2. PRIOR ART

Gendron U.S. Pat. No. 3,881,320, Dentz et al. U.S. Pat. No. 2,822,671, Burrell U.S. Pat. No. 2,830,433, Wilhelmi U.S. Pat. No. 1,213,441, Nadal U.S. Pat. No. 3,073,124, Dufresne U.S. Pat. No. 3,228,200, Schutte U.S. Pat. No. 3,316,723, Goodman U.S. Pat. No. 3,423,944, Stifler, Jr. U.S. Pat. No. 3,568,452, Turzillo U.S. Pat. No. 3,690,109, Cheiminski U.S. Pat. No. 3,707,848, Gilbred U.S. Pat. No. 3,842,609, Steding U.S. Pat. No. 3,851,485, French Pat. No. 704,448, French Pat. No. 1,186,222, English Pat. No. 393,641, English Pat. No. 1,361,182, USSR Pat. No. 160,493 and USSR Pat. No. 293,924.

OBJECTS

One of the long-established methods for in situ pile forming is to insert a mandrel into a pre-drilled hole, and then to dump or force concrete into the hole through the mandrel as the latter is lifted out of the hole. In Gendron (supra) an overboot is forced off the end of the mandrel while pressurized concrete is pumped through the mandrel and into the bottom of the hole.

Such methods wherein concrete is pumped into the mandrel under pressure have certain disadvantages in that the concrete usually has to enter the mandrel through its top, and this requires a long hose and a very powerful and expensive pump, and the concrete must be relatively thin and runny. Concrete of this consistency tends to "blow by", between the outer side of the mandrel and the inner side of the hole, and this release of pressure may leave voids that ruin the pile. In the method disclosed in my co-pending application (supra), the latter problem is solved by an inflatable seal, and this makes an excellent pile, but the pumping problems and expenses persist. In methods where concrete is dumped into the hole via a mandrel, relatively thick concrete may be used, but voids may occur.

The primary object of this invention is to provide a method wherein relatively thick concrete is dumped into the hole via the top of an over-booted mandrel. The mandrel is sealed and air under pressure is forced into the upper portion of the mandrel, and the mandrel is then hoisted while its interior remains pressurized. By this method a good seal between the outer side of the mandrel and the side of the hole is formed by the thick concrete, and the latter is firmly compacted and forced outwardly against the hole sides. The air pressure within the mandrel assists in ejecting the concrete through its lower end (the overboot being left behind), and it also assists in lifting the mandrel upwardly in the hole.

A further object is to provide concrete dumping apparatus which facilitates the loading of a dump bucket with concrete at ground level and the dumping of the concrete into the hole of the pile, which during the latter stages of the process, is high above the ground. Further objects are the provision of remotelycontrolled, sealable access doors at the top of the pile for the entrance of concrete and for the placement of reinforcing elements or cages.

These and other objects will be apparent from the following specification and drawings, in which.

Figure 2:
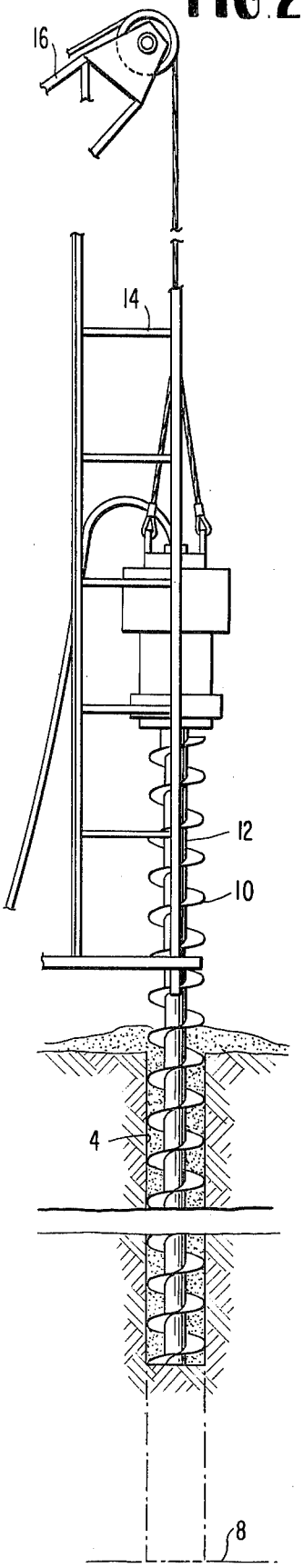
FIG. 2 is a diagrammatic side elevation showing the pre-drilling of the hole for the pile.
Figure 3:
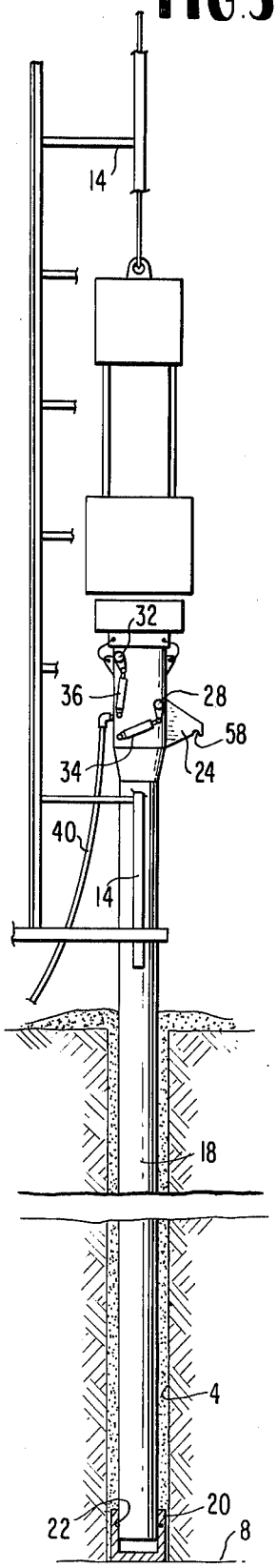
FIG. 3 is a view similar to FIG. 2, but showing the insertion of the mandrel into the pre-drilled hole, the concrete dumping apparatus having been shown, as removed, for clarity.
Figure 4:
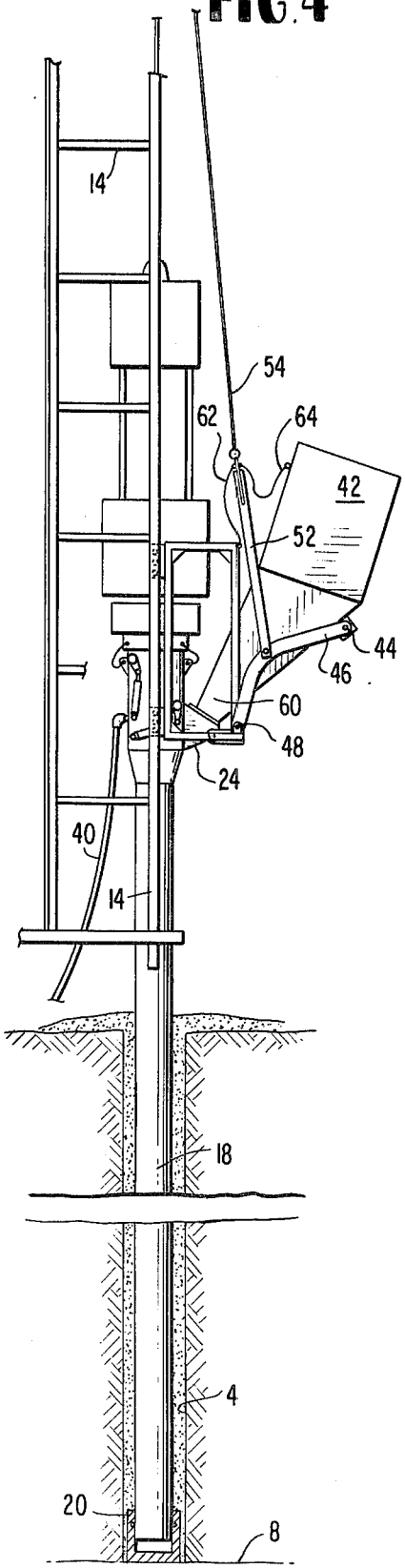
FIG. 4 is a view similar to FIGS. 2 and 3, but showing the dumping concrete through the mandrel into the hole.

The method and apparatus is for in situ formation of the concrete pile 2 in a pre-drilled hole 4, which pile may or may not have a reinforcing steel cage 6 therein is as follows:

Referring first to FIG. 2, a hole 4 is pre-drilled to a bearing strata 8 by a conventional wet drill 10 whose stem 12 extends upwardly through leads 14 supported by a crane 16. A hollow mandrel 18 having an overboot 20 sealed around the lower end thereof by an O-ring 22 is lowered into the pre-drilled hole (FIG. 3), forcing out most of the drilling mud, until the overboot rests upon the bearing strata. The diameter of the hole is slightly larger than the diameter of the overboot. The overboot is then seated into the bearing strata by a few blows from a pile hammer in leads 14.

Figure 1:
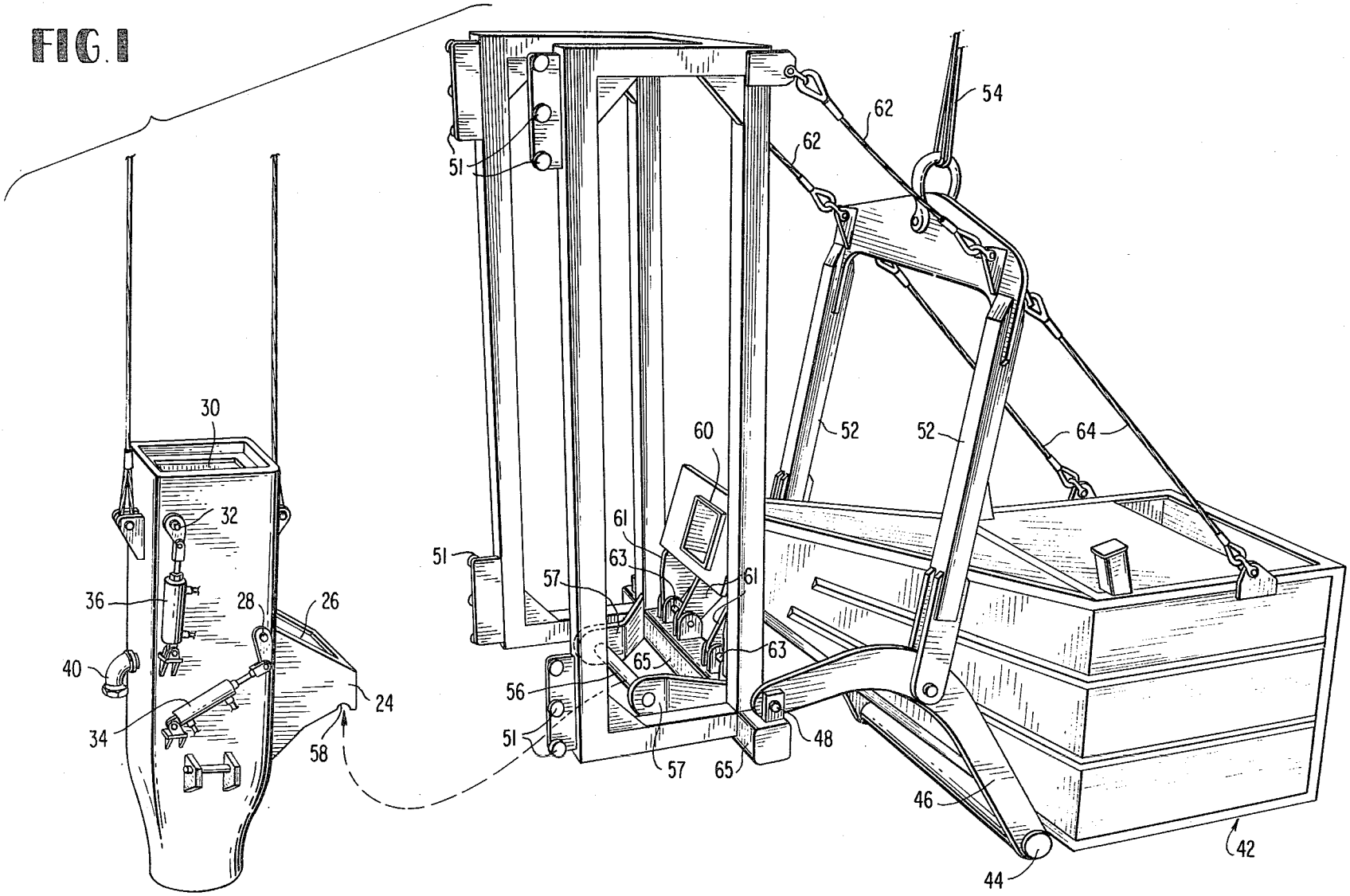
FIG. 1 is a perspective view of the top of a mandrel and the concrete dumping apparatus which cooperates therewith.

On the side of mandrel 18 near its tip is a chute 24 having a door 26 pivoted as at 28 (FIG. 1). The mandrel also has a top door 30 pivoted as at 32. Air jacks 34 and 36 having conventional air-supply lines (not shown) are provided for closing the chute door 26 and the top door 38. An air hose 40 connected to a source of compressed air (not shown) leads into the upper portion of the mandrel.

Figure 5:
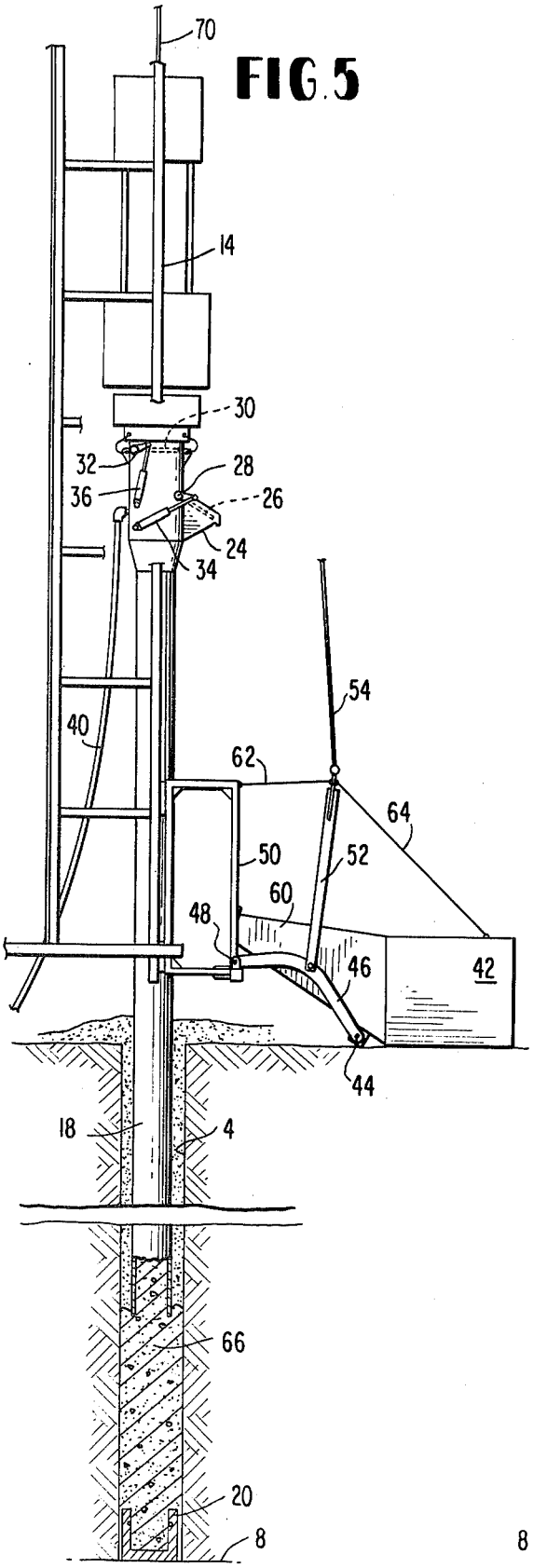
FIG. 5 is a view similar to FIGS. 2–4, but showing the step of lifting the mandrel from the hole partly filled with concrete while applying air under pressure to the then sealed upper portion of the mandrel, the concrete dumping apparatus having been lowered for re-filling.
Figure 6:
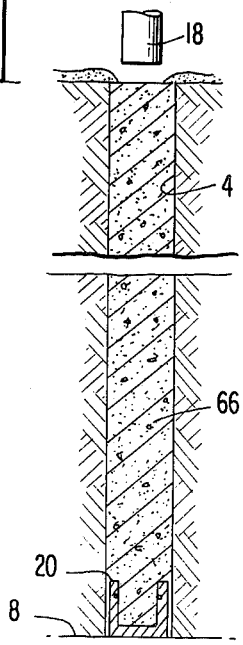
FIG. 6 is a view similar to FIG. 5, but showing the lifting of the mandrel from the filled hole; and, FIG. 7 illustrates the insertion of a re-inforcing cage into the concrete filled hole.

A bucket 42 is supported as at 44 on arms 46 whose inner ends are pivoted as at 48 to a frame 50. Frame 50 has rollers 51 upon which it slides upwardly and downwardly in channels (not shown) on leads 14. Arms 46 are connected by links 52 to a hoisting cable 54. A cross bar 56 supported on frame 50 by arms 56 engages into notches 58 on the underside of chute 24 so as to limit the upward sliding movement of frame 50 on leads 14; and when this occurs, further hoisting force applied by cable 54 causes arms 46 to swing counterclockwise around pivots 58 so as to tip up the bucket 42, and this swings its spout 60 down over the chute 24 and dumps the concrete 66 down into mandrel 18. Arms 61 on spout 60 swing about pivot 63 on the frame cross member 65 so that when the outer end of the pocket swings up, the spout 60 registers onto chute 24. When a bucket load of concrete has been dumped into the mandrel, the hoisting force on cable 54 is relaxed so that the frame 50 slides down the leads and bucket 42 tips back downwardly and outwardly to its position. Cables 62 and 64 limit the downward and outward swinging of bucket 42. This process is repeated until the mandrel is filled with concrete 66. Then chute door 24 and top door 30 are closed by operating air jacks 34 and 36, air under about 200 pounds pressure is introduced into the upper portion of the mandrel by means of air hose 40, and a mechanical hoisting force is applied to the mandrel by cables 70 (FIG. 5). The weight of the concrete plus the pressure of the air pushes the overboot 20 off the lower end of the mandrel as extraction of the mandrel begins.

As the mandrel is hoisted out of the hole, the air pressure inside serves to force the concrete out tightly against the walls of the hole resulting in a very dense compact pile with no opportunity for the soil surrounding the hole to close into the hole as would be the case if the concrete were fed from the mandrel by gravity alone. In addition, the concrete mix used in the pile is too stiff and course to flow readily, the result being that it forms a seal between the mandrel and the soil which eliminates the danger of blow-by, which generally results in a ruined pile.

Inasmuch as the diameter of the drilled hole is larger than the diameter of the mandrel by an inch or so, unless the mandrel is much longer than the drilled hole, the concrete supply in the mandrel will have to be replenished during the extraction process, for example, when the mandrel is about half way up out of the hole. To do this, the mandrel is depressurized by bleeding the air supply line 40. The chute door 26 is open and by sonically testing, the height of the concrete in the mandrel can be determined and the additional concrete needed to finish the pile can be calculated. Then, allowing for little waste and for hole irregularity, the correct amount of concrete is loaded into bucket 42 and an upward pulling force is applied by cable 54, thereby sliding the frame with the bucket thereon up the leads until the trip point of the bucket is reached and again the bucket is tipped up and enough concrete is dumped into the mandrel to finish the pile. When the bottom of the mandrel is a few feet from the ground surface, the air line 40 is bled and the extraction is continued until the mandrel is out of the ground and the pile is completed.

Figure 7:
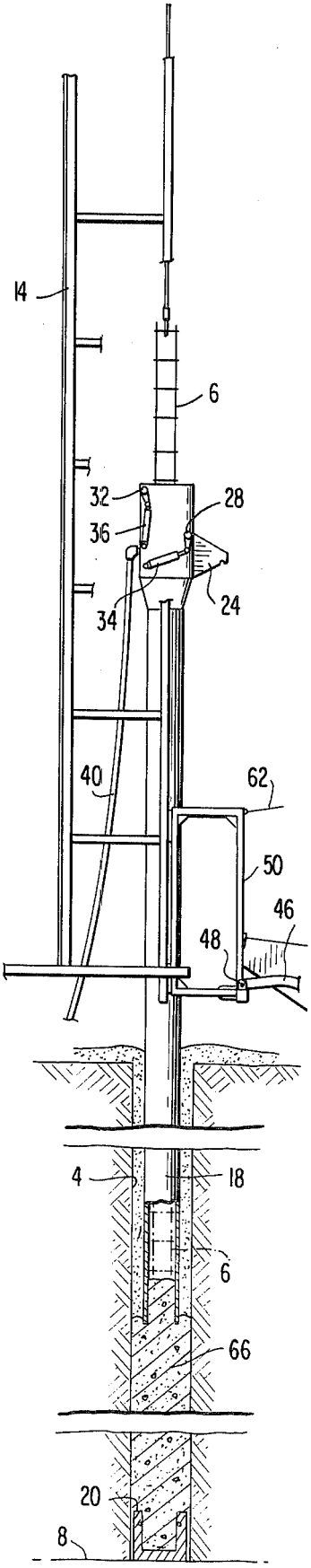

Oftentimes the designer will want to place reinforcing steel into the pile. A reinforcing steel cage may vary in length from the full pile length to just a few feet in length. In any event, during the course of the pile installation, whenever the length of the pile yet to be poured is equal to the length of the reinforcing steel cage desired to be left below ground, the air pressure line 40 is bled, the top door 30 of the mandrel is opened, and the reinforcing cage 6 is lowered down into the mandrel (FIG. 7). The chute door 26 is then opened, the mandrel is filled with the required amount of concrete, the chute and top doors 26 and 30 are closed, the mandrel is again pressurized, and the hoisting operation ensues.

I claim:

1. The method of forming in situ a casingless pile which comprises:

pre-drilling into the ground a hole, inserting into the pre-drilled hole a hollow mandrel having an open top and closure means associated therewith, at least partly filling the mandrel with low slump concrete from the (bottom) bottum up by dumping the concrete from a hopper through the open top thereof, so that the concrete falls entirely by gravity from the hopper into the bottom of the mandrel, then sealing the upper portion of the mandrel by operating said closure means so as to close said open top to the atmosphere then forcing air under pressure into the sealed upper end of the mandrel until the weight of the concrete in the mandrel and the pressure of the air compacts the concrete and forces some of it between the lower end of the mandrel and the side of the hole and forms a seal between the lower end of the mandrel and the side of the hole, and hoisting the mandrel upwardly from the hole.

2. The method claimed in claim 1, wherein the hole is wet pre-drilled and drilling mud is present in the hole when the mandrel is inserted, and the mandrel has a removable closure on the lower end thereof when inserted, and further including the step of utilizing the forces of the air pressure and the weight of the concrete in the mandrel to remove the closure as the mandrel is hoisted from the hole.

3. The method claimed in claim 2, wherein the inner diameter of the hole is greater than the outer diameter of the mandrel.

4. The method claimed in claim 3, wherein the bottom closure for the mandrel is an overboot, and wherein the inner diameter of the hole is greater than the outer diameter of the overboot.

* * * * *